US007647730B1

(12) United States Patent
Inzeo et al.

(10) Patent No.: US 7,647,730 B1
(45) Date of Patent: Jan. 19, 2010

(54) ROOF EDGING SYSTEM

(75) Inventors: Joseph A. Inzeo, West Allis, WI (US); Scott A. Kittilstad, Waukesha, WI (US)

(73) Assignee: Metal-Era, Inc., Waukesha, WI (US)

( * ) Notice: Subject to any disclaimer, the term of this patent is extended or adjusted under 35 U.S.C. 154(b) by 628 days.

(21) Appl. No.: 11/517,152

(22) Filed: Sep. 7, 2006

(51) Int. Cl.
*E04D 3/00* (2006.01)

(52) U.S. Cl. ..... 52/60; 52/58; 52/96; 52/97; 52/94; 52/300; 52/61

(58) Field of Classification Search ..... 52/60, 52/58, 97, 300, 716.2, 718.04, 360, 94, 96, 52/467, 717.06, 718.05
See application file for complete search history.

(56) References Cited

U.S. PATENT DOCUMENTS

| | | | | | |
|---|---|---|---|---|---|
| 1,940,933 | A * | 12/1933 | Balduf | 52/467 |
| 2,702,514 | A * | 2/1955 | Dalley | 52/61 |
| 3,533,201 | A * | 10/1970 | Tyler | 52/60 |
| 4,483,112 | A * | 11/1984 | Rueblinger | 52/94 |
| 4,641,476 | A * | 2/1987 | Webb et al. | 52/60 |
| 4,759,157 | A * | 7/1988 | Webb et al. | 52/60 |
| 4,780,995 | A * | 11/1988 | Gittins | 52/60 |
| 4,800,689 | A * | 1/1989 | Lane | 52/60 |
| 4,848,045 | A * | 7/1989 | Nichols et al. | 52/60 |
| 4,964,248 | A * | 10/1990 | Braine et al. | 52/60 |
| 5,189,853 | A * | 3/1993 | Braine et al. | 52/96 |
| 5,619,827 | A * | 4/1997 | Church | 52/60 |
| 5,893,247 | A * | 4/1999 | Hickman et al. | 52/300 |
| 5,927,023 | A * | 7/1999 | Kittilstad | 52/60 |
| 6,212,829 | B1 * | 4/2001 | Webb et al. | 52/96 |
| 6,360,504 | B1 * | 3/2002 | Webb et al. | 52/300 |
| 6,578,322 | B2 * | 6/2003 | Kintop | 52/96 |
| 6,606,828 | B1 * | 8/2003 | Lin et al. | 52/58 |
| 6,786,018 | B2 * | 9/2004 | Webb et al. | 52/300 |
| 6,845,590 | B1 * | 1/2005 | Mills, Jr. | 52/60 |
| 6,912,813 | B2 * | 7/2005 | Grizenko | 52/58 |
| 6,912,814 | B1 * | 7/2005 | Inzeo et al. | 52/60 |
| 7,168,209 | B2 * | 1/2007 | Heidler, Jr. | 52/60 |
| 7,451,572 | B1 * | 11/2008 | Inzeo et al. | 52/60 |
| 7,487,618 | B2 * | 2/2009 | Lin | 52/84 |
| 2002/0083666 | A1 * | 7/2002 | Webb et al. | 52/300 |
| 2003/0061771 | A1 * | 4/2003 | Kintop | 52/97 |
| 2003/0121217 | A1 * | 7/2003 | Grizenko | 52/60 |

* cited by examiner

*Primary Examiner*—Richard E Chilcot, Jr.
*Assistant Examiner*—Mark R Wendell
(74) *Attorney, Agent, or Firm*—Donald J. Ersler

(57) ABSTRACT

A roof edging system for providing a functional and aesthetically pleasing appearance of a periphery of a building roof is provided. The system includes a rail positioned about an upper perimeter of a building. The rail is also constructed to sealingly engage a roofing membrane placed about the roof that is free of perforations. A cover or fascia engages the rail and is secured to the rail without fasteners. Such a construction provides a roof edging system, which can be quickly secured to a building and provides an exterior surface.

16 Claims, 7 Drawing Sheets

ROOF EDGING SYSTEM

FIELD OF THE INVENTION

The present invention relates to roof edging and water proofing systems, and more specifically to a roof edging system having an opening-free fascia member snap fittingly engaged to an underlying rail member.

BACKGROUND OF THE INVENTION

Many types of buildings have flat roofs with exposed roof edges that must be sealed in order to prevent water from leaking into the interior of the building. The roofs on buildings of this type generally include fully adhered or mechanically attached single ply roofs or built up or modified roof systems, among others. In order to effectively seal the roofs of these buildings, many different roof edging systems, such as fascias and copings, have been developed which cooperate with a roofing membrane placed over the roof to prevent water from entering a building between the membrane and the remainder of the building.

Known roof edging systems generally include a rail constructed to be attached to the building structure, a counter-flashing constructed to sealingly connect the roofing membrane and the rail, and a fascia member constructed to be positioned over the rail. Frequently, the rail and fascia includes hook and tab members so that the fascia can be snap-fit connected to the rail. Fasteners and splice plates secure the ends of adjacent sections of fascia to the rail. Understandably, such multi-component roof edging systems are relatively complex and require installation by skilled technicians in order to ensure an aesthetic and properly functioning roof edge. Accordingly, it is desirable to provide a simplified and less labor intensive roof edging system.

Another consideration to such roof edging systems is the engagement of the fascia with the adjoining roof edging system structure. That is, due in part to the roof edging systems' exposure to the elements, it is necessary to ensure that the fascia is securely and sealingly attached to the underlying roof edging system. Failure to securely connect the fascia to the roof edging system could result in unexpected removal of the fascia from the roof edging system during windy conditions. Furthermore, as the roof edging system seals a perimeter of the building to which it is attached, it is also desirable to provide a non-perforated fascia member to prevent the passage of moisture therethrough.

An additional consideration to roof edging system construction is the operability of the roof edging system with a variety of roof deck membrane configurations. That is, there are a variety of widely accepted roof membrane configurations. The roof membrane is commonly a single or multiple plies of a rubber-type and/or tar-type material that is laid across the roof of the structure. Joints in the roof membrane are sealed and the perimeter of the roof membrane is sealed about the perimeter of the structure by the roof edging system. Rather than providing a roof edging system tailored to a specific roof membrane, it is also desirable to provide a multifunctional roof edging system that is operable with a plurality of roof membrane configurations.

SUMMARY OF THE INVENTION

The present invention is directed to a roof edging system that solves the aforementioned problems. A roof edging system for providing a functional and aesthetically pleasing appearance of a periphery of a building roof is provided. The system includes a rail positioned about an upper perimeter of a building. The rail is also constructed to sealingly engage a roofing membrane placed about the roof. A cover or fascia member snap fittingly engages the rail and is secured to the rail without fasteners. Such a construction provides a roof edging system that can be quickly secured to a building and provides an exterior surface that is free of perforations.

Therefore, in accordance with one aspect of the present invention, a roof edging system having a rail, a spring clip, and a cover is disclosed. The rail has a first section constructed to extend along a wall and a second section constructed to extend over a roof. A first tab is formed on the first section of the rail and a second tab is formed on the second section of the rail. The first tab and the second tab are orientated in generally crossing directions. The cover has a first hook structured to engage the first tab of the rail and a second hook constructed to engage the second tab of the rail so that the cover snap fittingly engages the rail. The spring clip is engaged with the second section of the rail between the first tab and the second tab such that the spring clip tensions the second hook against the second tab such that a tension direction is generally parallel with the roof. In accordance with another aspect of the present invention, a roof edging assembly including a rail, a cover, a spring clip and a cant is disclosed. The cant may be included with the roof edging system or preinstalled on the edge of a roof as in the first embodiment. The cant is structured to engage a roof surface and a wall surface.

Various other features, objects, and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
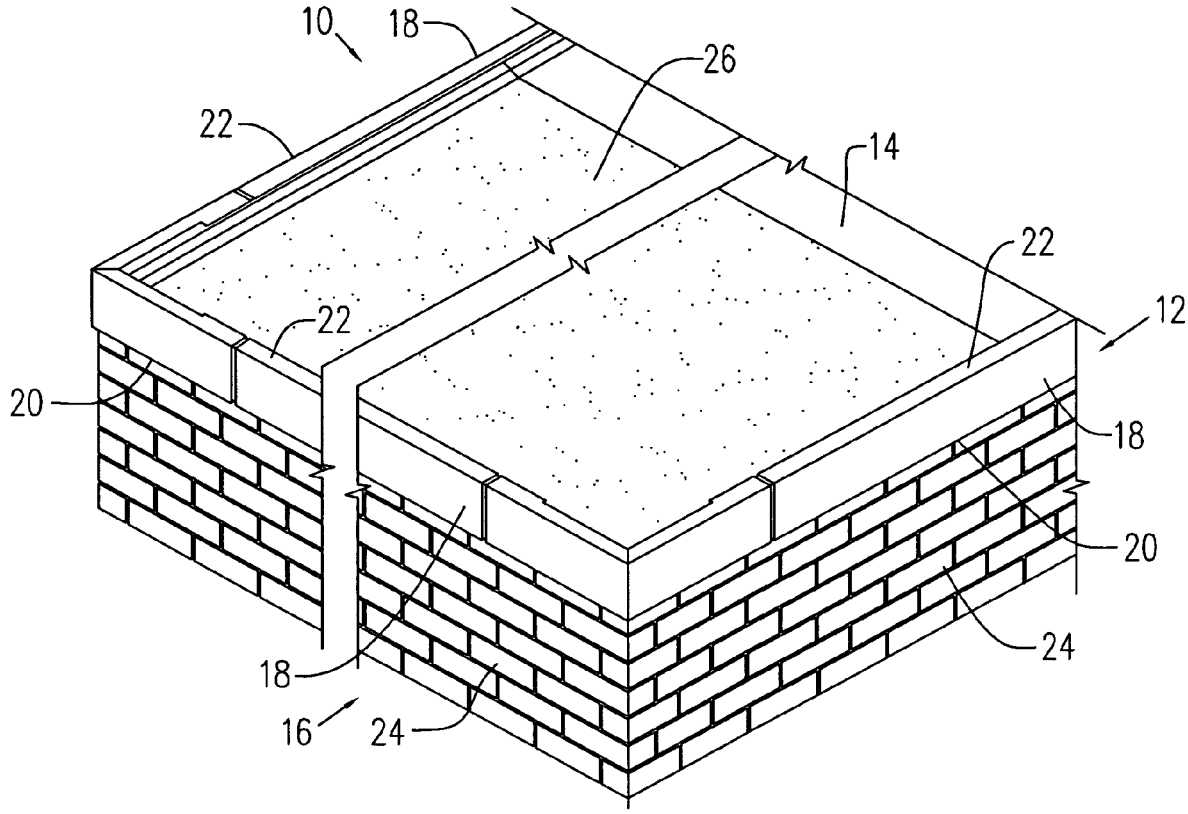
FIG. 1 is a perspective view of a roof edging system according to the present invention.

FIG. 1 shows a roof edging system 10 according to the present invention positioned about a perimeter 12 of a roof 14 of a building 16. The roof edging system 10 includes a plurality of side sections 18 which are oriented to generally encircle the perimeter 12 of building 16. Each side section 18 includes a wall portion 20 and a roof portion 22. The wall portions 20 are generally orientated such that they extend in a direction generally parallel to a respective wall 24 of building 16. Comparatively, roof portions 22 extend in a direction generally parallel to roof 14. A roof seal or membrane 26 generally extends about the roof 14 within the area generally circumscribed by the roof edging system 10. Membrane 26 is sealingly connected to the roof edging system 10 such that precipitation collected within perimeter 12 of roof 14 can be directed to a scupper (not shown) or other drain system. Such construction ensures that the roof system of building 16 is weather tight.

Figure 2:
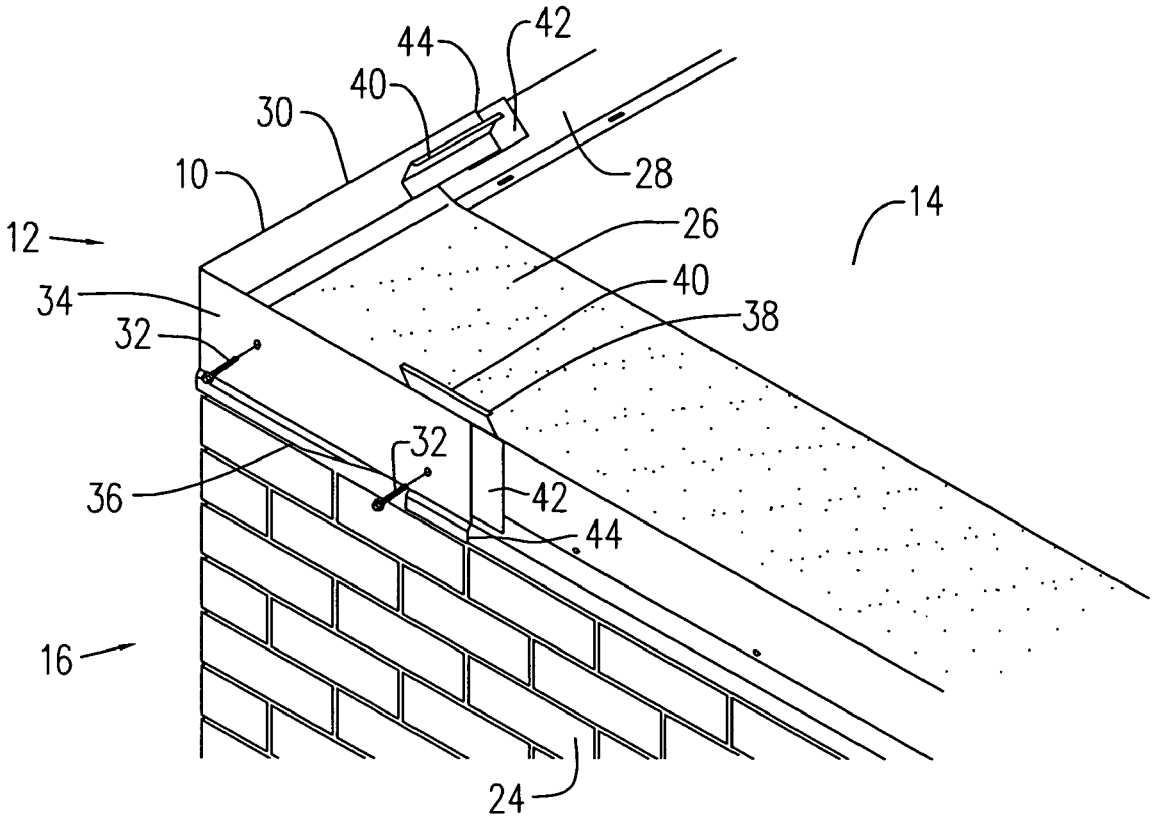
FIG. 2 is a perspective view of a rail of the roof edging system shown if FIG. 1.
Figure 3:
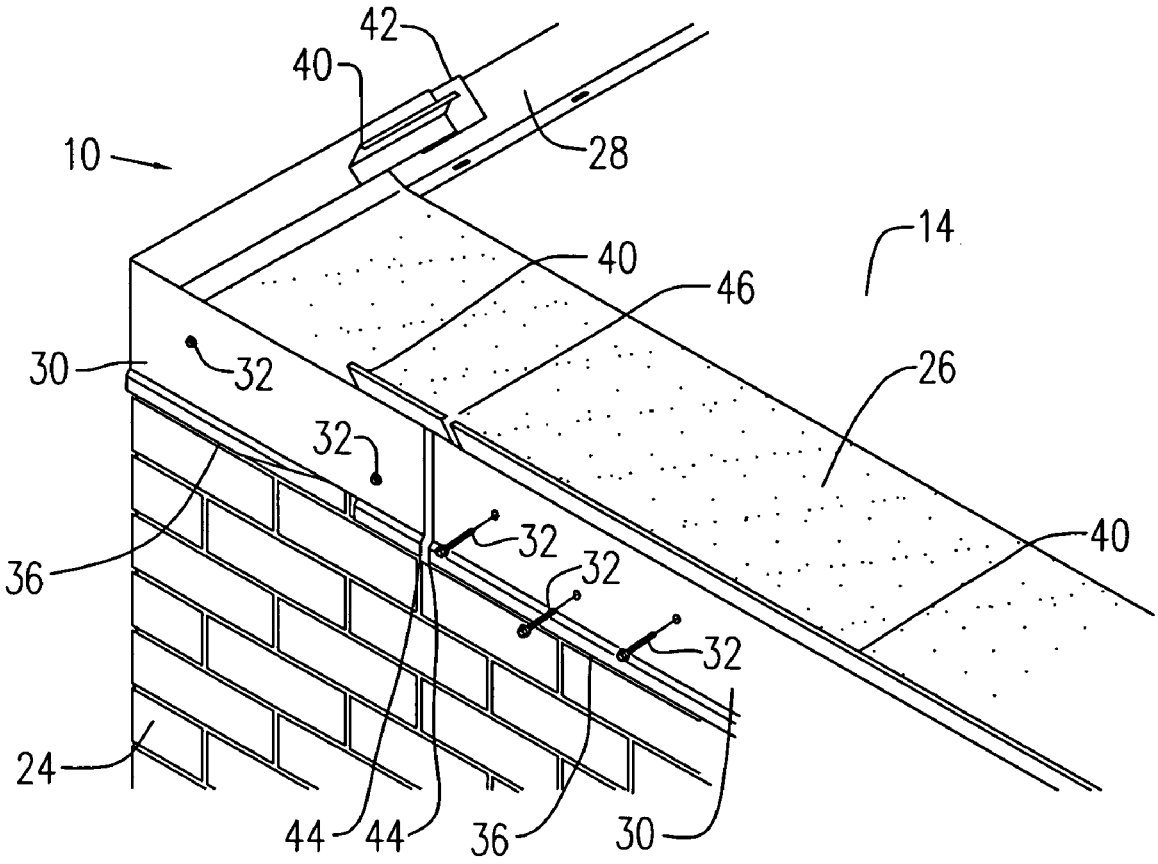
FIG. 3 is a perspective view showing the roof edging system with an additional rail section connected thereto.

FIG. 2 is a perspective view of a corner of the underlying components of the roof edging system 10. The roof edging system 10 shown in FIG. 2 is not commonly visible from a ground position when a fascia member is positioned thereabout. As shown in FIG. 2, a membrane 26 engages a water dam, cant dam, or cant 28. The cant 28 is contoured to extend upward above the roof 14. The cant 28 may be preinstalled on the edge of a roof, before the roof edging system is installed or the roof edging system further includes the cant 28. The rail 30 engages the cant 28 with the membrane 26 snugly and sealingly disposed therebetween. The sealing engagement of the membrane 26 between rail 30 and cant 28, in addition to the inclined configuration of the cant 28, ensures that water collected across the membrane 26 can be directed to a desired discharge location. A plurality of fasteners 32 engage wall 24 and secure rail 30 to the building 16. A first section or wall section 34 of rail 30 is oriented along wall 24 and includes a first edge or tab 36 constructed to engage a fascia member. A roof section or second section 38 of rail 30 extends over the roof 14 and includes another edge or second tab 40 formed thereon. Tabs 36, 40 are constructed and orientated to snap fittingly engage a fascia member or cover 48 and secure the cover 48 to the rail 30. A faceplate, joint plate, plate, or splice plate 42 as described further below with respect to FIG. 3 is disposed adjacent to at least one end 44 of the rail 30. Understandably, the corner construction of rail 30 could be provided in a unitary component or alternatively formed on-site.

FIG. 3 shows the attachment of an adjacent rail 30 at abutting ends 44. Splice plate 42 is enclosed behind abutting ends 44 thereby sealing joint 46 formed between adjacent rails 30. Such a construction ensures that anything penetrating the cover 48 of roof edging system 10, cannot pass beyond the substantially continuous orientation of rails 30. As such, in the event of minor damage to the cover of the roof edging system, roof edging system 10 may still provide some degree of water-tightness to the building to which it is installed.

Figure 4:
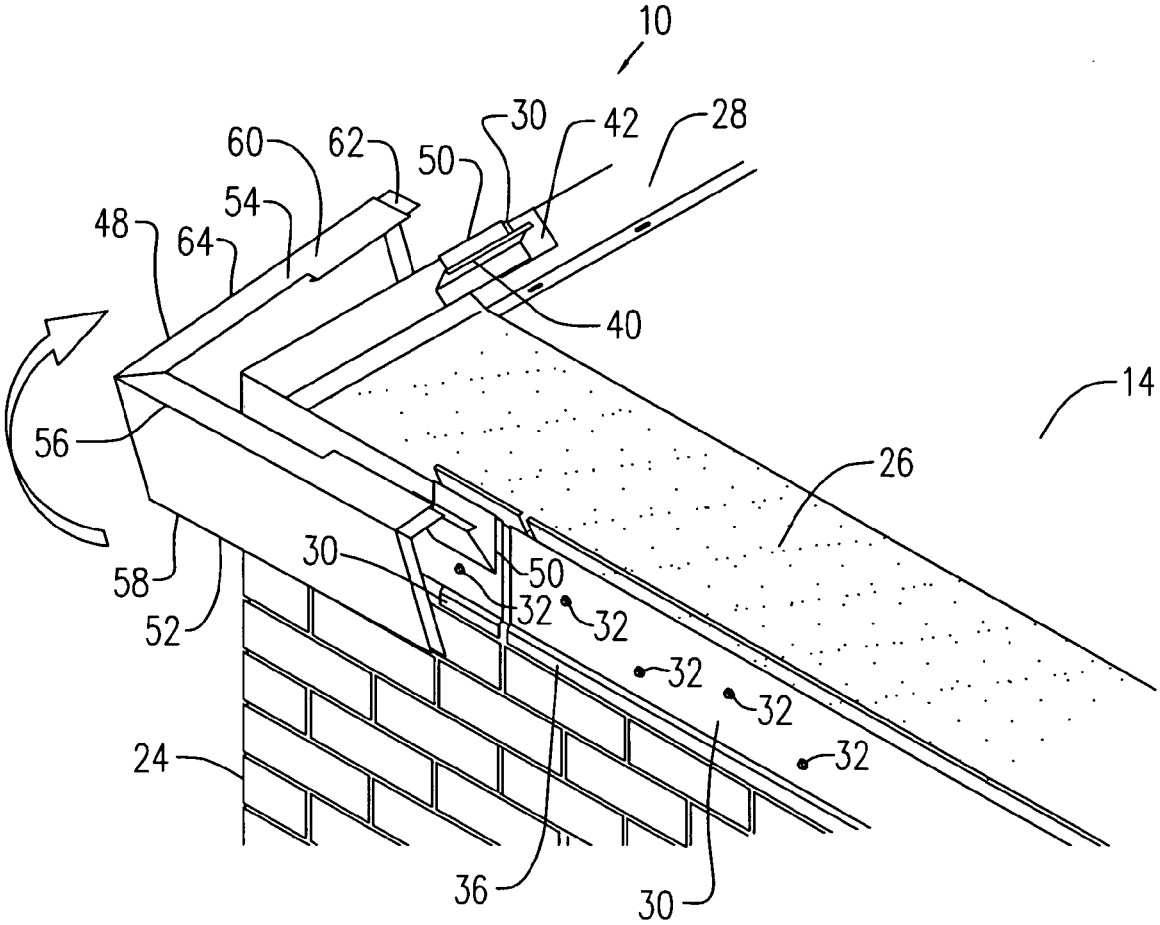
FIG. 4 is a perspective view of the roof edging system shown in FIG. 1 with a fascia member exploded therefrom.

FIG. 4 shows the cover 48, which is non-perforated and a plurality of spring clips 50 of the roof edging system 10. With respect to FIG. 6, the spring clips 50 are slidably engaged to the rail 30 and constructed to be disposed between the rail 30 and the cover 48. The cover 48 includes a wall section (first section) 52, a roof section (second section) 54, and a corner 56 therebetween. A wall end 58 of the cover 48 is constructed to engage the first tab 36 of the rail 30. A roof end 60 of the fascia member 48 is constructed to snap fittingly engage the second tab 40 of the rail 30. Spring clip 50 is constructed to bias the roof end 60 of the cover 48 against the second tab 40 of the rail 30, thereby securing the cover 48 to the roof edging system 10. Similar to rail 30, the cover 48 could be pre-configured to provide the corner formation of the roof edging system 10 or field assembled in such an orientation. A cover splice 62 extends from at least one end 64 of the cover 48 and is structured to receive additional covers.

Figure 5:
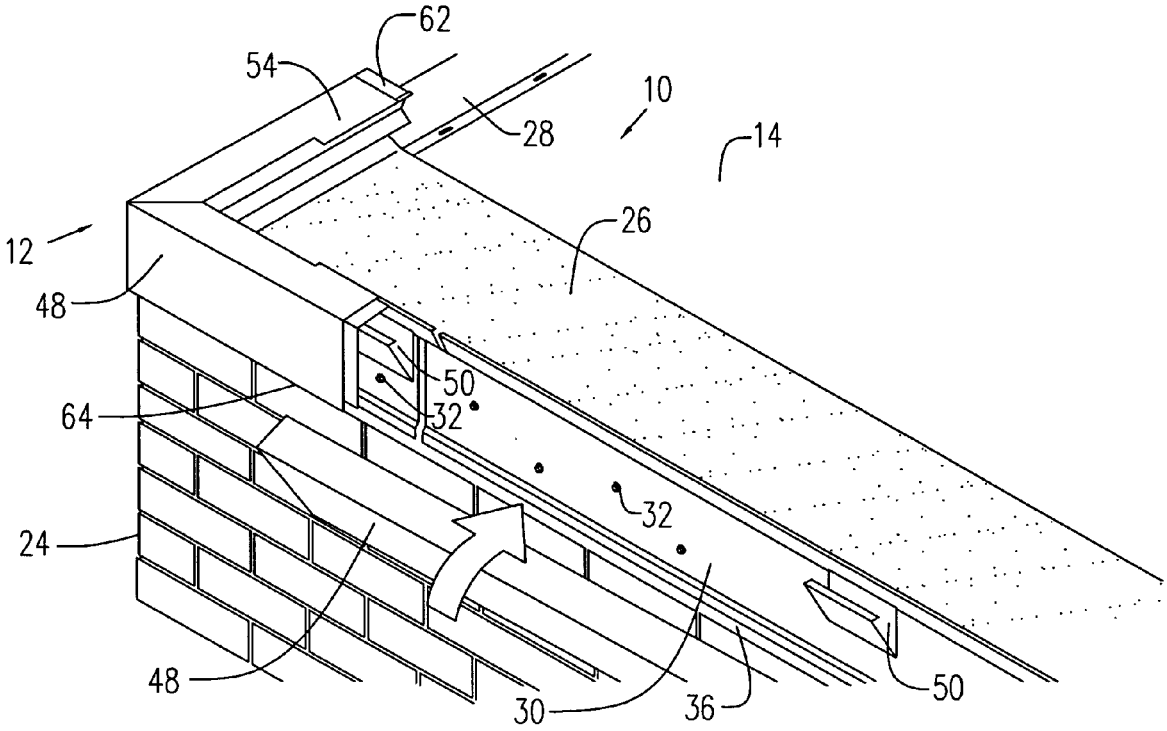
FIG. 5 is a perspective view of the roof edging system similar to that shown in FIG. 4 with another fascia member exploded therefrom.

FIG. 5 shows additional spring clips 50 secured to the rail 30 about the perimeter 12 of the roof 14. The covers 48 snap fittingly engage rail 30 and are secured thereto by spring clips 50. The cover splice 62 provides a sealed engagement between the ends 64 of adjacent covers 48. Such a construction provides a roof edging system, wherein the external component thereof is free of perforations or openings and is attached to the underlying assembly without fasteners or the like. Such a construction provides a roof edging system that is quickly and easily connected to a building and sealingly engaged therewith.

Figure 6:
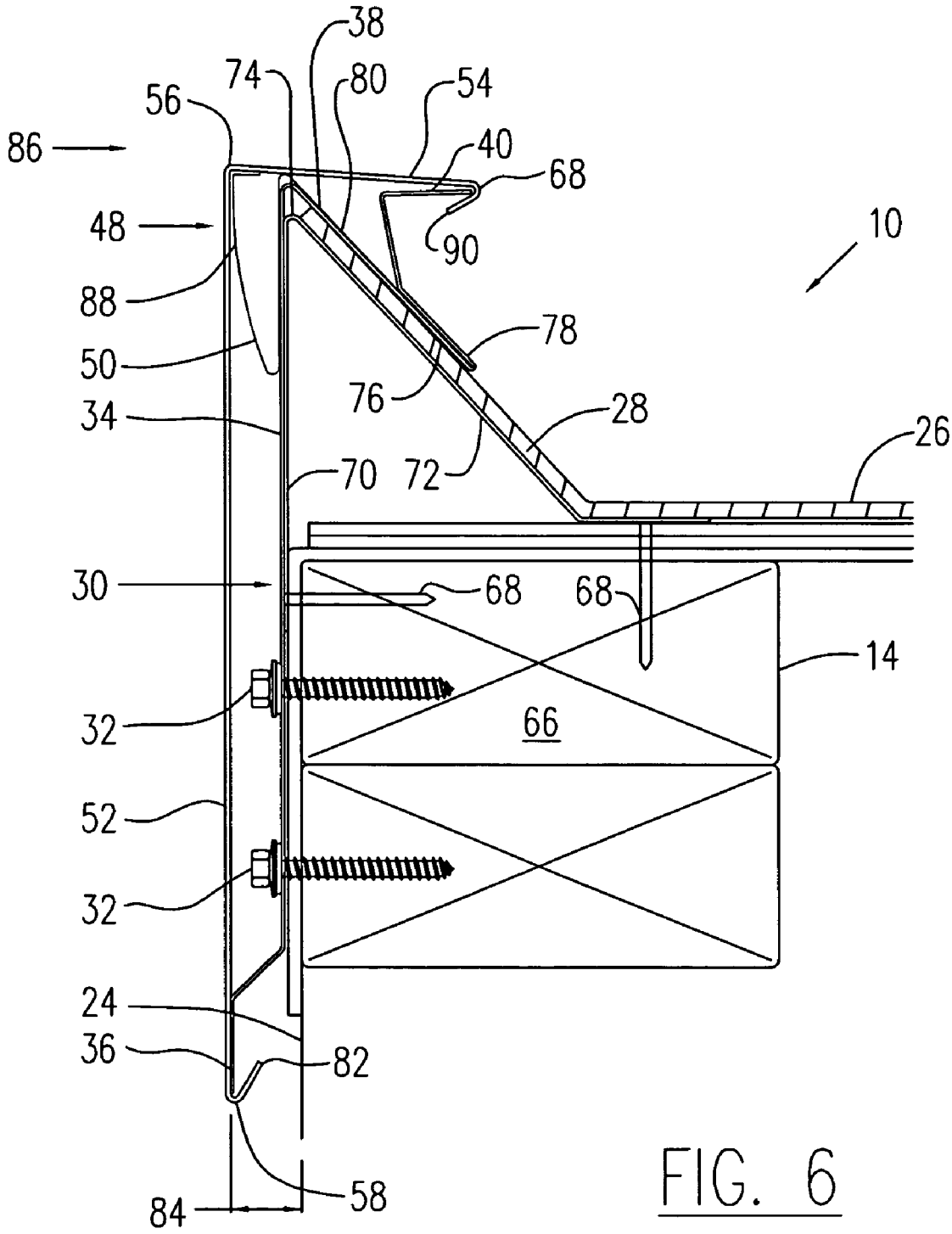
FIG. 6 is a cross-sectional view of the roof edging system shown in FIG. 1.

FIG. 6 shows a cross-section of roof edging system 10. Roof 14 includes a ledger 66 positioned about the perimeter 12 of the roof 14. The cant 28 is secured to the ledger 66 via a fastener 68. The cant 28 includes a first portion 70 that extends upwardly from the wall 24 and a second portion 72 extending between an end 74 of the first portion 70 and the roof 14. The membrane 26 traverses roof 14 and inclines along the second portion 72 of the cant 28. The rail 30 has a contour that generally matches a portion of the contour of the cant 28. The membrane 26 is sealingly disposed between an underside portion 76 of the rail 30 and the cant 28. A topside portion 78 is formed parallel with and adjacent to the underside portion 76, along the length of the rail 30 and is structured to snugly receive a leg 80 of the spring clip 50 therein. The underside portion 76 is normally in contact with the topside portion 78. The tab 36 is positioned at the lower end of the rail 30 and is constructed to slideably engage a first hook (first member) 82 of the cover 48. The first hook 82 snugly engages the tab 36 such that the wall section 52 of the cover 48 is engaged with the rail 30. First tab 36 is offset by some measurable distance 84, from the wall 24, thereby allowing a portion of the first hook 82 to pass between first tab 36 and wall 24. Once the first hook 82 is engaged with first tab 36, roof section 54 of the cover 48 is translated in the direction indicated by an arrow 86 such that wall section 52 of the cover 48 deflects a moveable arm 88 of the spring clip 50.

Deflection of moveable arm 88 allows a second hook (second member) 90 of the cover 48 to engage the second tab 40 of rail 30. Once the second hook 90 is positioned over second tab 40 of the rail 30, moveable arm 88 presses against the corner 56 of the fascia member 48, thereby tensioning the roof section 54 of the fascia member 48 between the corner 56 and the second hook 90. Such a construction adheres the cover 48 to the rail 30 with securing forces associated with tabs 36, 40 and hooks 82, 90 orientated in generally crossing or transverse directions. Such a construction ensures that, even without fasteners, fascia members 48 are securely attached to the underlying rail 30. Furthermore, eliminating the requirement of connecting the fascia members 48 with fasteners allows the fascia members 48 to be constructed without perforations, penetrations, or openings. Accordingly, once the covers 48 are positioned about a perimeter of a roof structure, the elimination of perforations reduces the possibility of penetration of precipitation beyond the covers 48.

Figure 7:
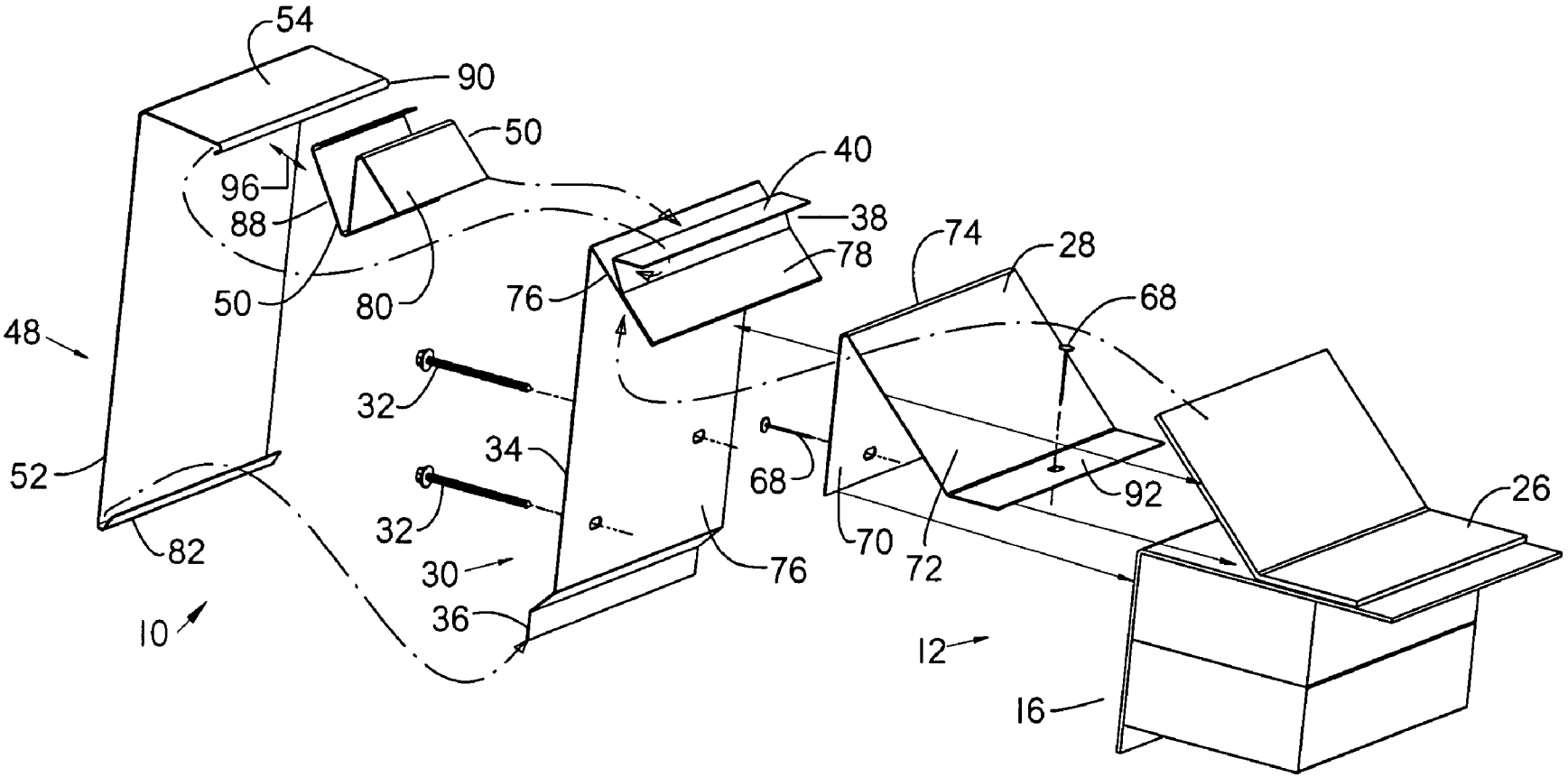
FIG. 7 is an exploded perspective view of the roof edging system shown in FIG. 1.

FIG. 7 is an exploded perspective view of the assembly of the roof edging system 10. The cant 28 is positioned about the perimeter 12 of the building 16. Membrane 26 sealingly engages an upper surface 92 of the cant 28. A plurality of fasteners 68 secure the cant 28 to the building 16. The second section 38 of the rail 30 is structured to operatively engage the cant 28 such that the membrane 26 is sealingly disposed therebetween. The leg 80 of the spring clip 50 is inserted between the topside portion 78 and the underside portion 76 of the rail 30. The moveable arm 88 of spring clip 50 translates in a direction indicated by the arrow 96. The translation of the moveable arm 88 ensures that the second hook 90 of the cover 48 engages the tab 40 of the rail 30. After the second hook 90 has traversed second tab 40 of the rail 30, the association of the second hook 90 and the tab 40 and the biasing of the moveable arm 88 of spring clip 50 secures the cover 48 to rail 30. Such construction provides a roof edging system that is quickly and efficiently connectible to a building structure, is operable with a plurality of flat roof membrane systems, and reduces the number of weather-exposed perforations of the roof edging system.

Various alternatives and embodiments are contemplated as being within the scope of the following claims, particularly pointing out and distinctly claiming the subject matter regarded as the invention.

What we claim is:

1. A roof edging system comprising:

a rail having a first section structured to extend along a wall and a second section constructed to extend over a roof; a first tab is formed on said first section of said rail, a second tab is formed on said second section of said rail;

a spring clip having a deflectable arm, said spring clip contacting said first section of said rail, said spring clip being engaged with said rail;

a cover having a wall section and a roof section, a first member extending from one end of said wall section, said roof section extending from the other end of said wall section, said first member for engaging said first tab, said deflectable arm of said spring clip forcing said wall section of said cover away from said first section of said rail such that said second tab is tensioned against a second member of said cover; and a roof membrane being located between said first section and the wall.

2. The roof edging system of claim 1 wherein said second tab and said second member are offset above a roof surface.

3. The roof edging system of claim 1 wherein said deflectable arm extends from said rail a distance substantially similar to an offset distance of said first tab.

4. The roof edging system of claim 1 wherein said first and second members have the shape of a hook.

5. A roof edging assembly comprising:

a cant being secured to an edge of a building;

a rail having a first section structured to extend along a building wall and a second section constructed to extend over a roof, a roof membrane being retained between said cant and said second section, the roof membrane being retained between said first section and the building wall;

a first tab being formed on said first section of said rail, a second tab being formed on said second section of said rail;

a spring clip having a deflectable arm, said spring clip contacting said first section of said rail, said spring clip being engaged with said rail; and a cover having a wall section and a roof section, a first member extending from one end of said wall section, said roof section extending from the other end of said wall section, said first member engaging said first tab, said deflectable arm of said spring clip forcing said wall section of said cover away from said first section of said rail such that said second tab is tensioned against a second member of said cover.

6. The roof edging system of claim 5 wherein said first and second members have the shape of a hook.

7. The roof edging system of claim 5 wherein said rail includes at least one bend proximate a first end constructed to offset said first tab from a plane of a building wall.

8. The roof edging system of claim 7 wherein the offset provides clearance for said first member of said cover adjacent a building wall.

9. The roof edging system of claim 5 wherein said second tab of said rail extends a variable distance above an upper roof surface and the variable distance is determined by a thickness of the roof membrane.

10. The roof edging system of claim 5 further comprising a cover splice extending from at least one end of said cover.

11. The roof edging system of claim 5 further comprising a splice plate extending from at least one end of said rail.

12. A method of forming a roof edging system comprising the steps of:

providing a rail having a first section and a second section, a first tab being formed on said first section of said rail, a second tab being formed on said second section of said rail;

providing a spring clip having a leg and a deflectable arm, said spring clip contacting said first section of said rail, said spring clip being engaged with said rail;

providing a cover having a wall section, a roof section extending from said wall section, a first member being formed on an end of said wall section, a second member being formed on an end of said roof section, said first member engaging said first tab, a second member engaging said second tab, said deflectable arm forcing said wall section away from said first section, said deflectable arm tensioning said second tab against said second member; and locating a roof membrane between said first section and a building wall.

13. The method of claim 12 further providing a cant structured to engage a roof and a wall of a building.

14. The method of claim 12 wherein said first section being oriented generally transverse to said second section.

15. The method of claim 12 wherein said rail is structured to sealingly engage an edge of the roof membrane.

16. The method of claim 12 further comprising connecting said rail about a perimeter of a roof with a plurality of fasteners and connecting said non-perforated cover about said rail to conceal each of said plurality of fasteners.

* * * * *